US006416023B1

(12) United States Patent
Satsky

(10) Patent No.: US 6,416,023 B1
(45) Date of Patent: Jul. 9, 2002

(54) BAG OPENING HOLDER

(76) Inventor: David A. Satsky, 107 Whisper Way, Boerne, TX (US) 78006-2969

( * ) Notice: Subject to any disclaimer, the term of this patent is extended or adjusted under 35 U.S.C. 154(b) by 0 days.

(21) Appl. No.: 09/641,856

(22) Filed: Aug. 18, 2000

(51) Int. Cl.[7] ..... B65B 67/04
(52) U.S. Cl. ..... 248/99
(58) Field of Search ..... 248/99, 95, 100, 248/101, 97; 294/1.1; 24/30.5 R, 30.5 P, 30 SL

(56) References Cited

U.S. PATENT DOCUMENTS

| | | | | | |
|---|---|---|---|---|---|
| 310,210 | A | * | 1/1885 | Liedel | 248/99 |
| 637,248 | A | * | 11/1899 | Hagstrom | 248/99 |
| 755,085 | A | * | 3/1904 | Viano | 248/99 |
| 1,005,014 | A | * | 10/1911 | Franke | 248/99 |
| 2,100,235 | A | * | 11/1937 | Brown | 248/99 |
| 3,841,592 | A | * | 10/1974 | Witten | 248/101 |
| 3,893,649 | A | | 7/1975 | Cornell et al. | |
| 4,488,697 | A | * | 12/1984 | Garvey | 248/97 |
| 4,759,518 | A | * | 7/1988 | Yardas | 248/97 |
| 4,955,566 | A | * | 9/1990 | Bolich | 248/101 |
| 5,020,751 | A | * | 6/1991 | Larkin | 248/99 |
| 5,082,219 | A | | 1/1992 | Blair | |
| 5,217,271 | A | | 6/1993 | Moe | |
| 5,377,941 | A | * | 1/1995 | Har et al. | 248/101 |
| 5,456,431 | A | * | 10/1995 | Ilnisky | 248/98 |
| 5,518,212 | A | | 5/1996 | Sigler | |
| 5,588,622 | A | | 12/1996 | Gordon, Sr. | |
| 5,641,138 | A | * | 6/1997 | Cronk et al. | 248/99 |
| D386,867 | S | | 11/1997 | Clark | |
| 5,836,553 | A | * | 11/1998 | Bergaila | 248/99 |
| 5,913,496 | A | * | 6/1999 | Valdez | 248/99 |
| 6,105,217 | A | * | 8/2000 | Caradine et al. | 24/30.5 R |

* cited by examiner

*Primary Examiner*—Daniel P. Stodola
*Assistant Examiner*—Jennifer E. Novosad

(57) ABSTRACT

A bag opening holder for holding a bag open so that the user can easily place objects inside the bag. The bag opening holder includes a first ring member having an opening therethrough; and also includes a second ring member having an opening therethrough and being hingedly attached. to the first ring member; and further includes handle members having a first handle member being securely attached to the first ring member and also having a second handle member being securely attached to the first and second ring members; and also includes fastening members being spaced apart and being securely attached to the first ring member for securely fastening the first ring member to the second ring member and about an upper portion of a bag.

6 Claims, 3 Drawing Sheets

BAG OPENING HOLDER

BACKGROUND OF THE INVENTION

1. Field of the Invention

The present invention relates to a bag holder and more particularly pertains to a new bag opening holder for holding a bag open so that the user can easily place objects inside the bag.

2. Description of the Prior Art

The use of a bag holder is known in the prior art. More specifically, a bag holder heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,082,219; U.S. Pat. No. 5,518,212; U.S. Pat. No. 5,588,622; U.S. Pat. No. Des. 386,867; U.S. Pat. No. 5,217,271; and U.S. Pat. No. 3,893,649.

While these devices fulfill their respective, particular objectives and requirements, the aforementioned patents do not disclose a new bag opening holder. The inventive device includes a first ring member having an opening therethrough; and also includes a second ring member having an opening therethrough and being hingedly attached to the first ring member; and further includes handle members having a first handle member being securely attached to the first ring member and also having a second handle member being securely attached to the first and second ring members; and also includes fastening members being spaced apart and being securely attached to the first ring member for securely fastening the first ring member to the second ring member and about an upper portion of a bag.

In these respects, the bag opening holder according to the present invention substantially departs from the conventional concepts and designs of the prior art, and in so doing provides an apparatus primarily developed for the purpose of holding a bag open so that the user can easily place objects inside the bag.

SUMMARY OF THE INVENTION

In view of the foregoing disadvantages inherent in the known types of bag holder now present in the prior art, the present invention provides a new bag opening holder construction wherein the same can be utilized for holding a bag open so that the user can easily place objects inside the bag.

The general purpose of the present invention, which will be described subsequently in greater detail, is to provide a new bag opening holder which has many of the advantages of the bag holder mentioned heretofore and many novel features that result in a new bag opening holder which is not anticipated, rendered obvious, suggested, or even implied by any of the prior art bag holder, either alone or in any combination thereof.

To attain this, the present invention generally comprises a first ring member having an opening therethrough; and also includes a second ring member having an opening therethrough and being hingedly attached to the first ring member; and further includes handle members having a first handle member being securely attached to the first ring member and also having a second handle member being securely attached to the first and second ring members; and also includes fastening members being spaced apart and being securely attached to the first ring member for securely fastening the first ring member to the second ring member and about an upper portion of a bag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of,the present invention. It is important, therefore, that the claims, be-regarded as including such equivalent constructions insofar as they do not depart from the spirit and scope of the present invention.

It is therefore an object of the present invention to provide a new bag opening holder which has many of the advantages of the bag holder mentioned heretofore and many novel features that result in a new bag opening holder which is not anticipated, rendered obvious, suggested, or even implied by any of the prior art bag holder, either alone or in any combination thereof.

It is another object of the present invention to provide a new bag opening holder which may be easily and efficiently manufactured and marketed.

It is a further object of the present invention to provide a new bag opening holder which is of a durable and reliable construction.

An even further object of the present invention is to provide a new bag opening holder which is susceptible of a low cost of manufacture with regard to both materials and labor, and which accordingly is then susceptible of low prices of sale to the consuming public, thereby making such bag opening holder economically available to the buying public.

Still yet another object of the present invention is to provide a new bag opening holder which provides in the apparatuses and methods of the prior art some of the advantages thereof, while simultaneously overcoming some of the disadvantages normally associated therewith.

Still another object of the present invention is to provide a new bag opening holder for holding a bag open so that the user can easily place objects inside the bag.

Yet another object of the present invention is to provide a new bag opening holder which includes a first ring member having an opening therethrough; and also includes a second ring member having an opening therethrough and being hingedly attached to the first ring member; and further includes handle members having a first handle member being securely attached to the first ring member and also having a second handle member being securely attached to the first and second ring members; and also includes fastening members being spaced apart and being securely attached to the first ring member for securely fastening the first ring member to the second ring member and about an upper portion of a bag.

Still yet another object of the present invention is to provide a new bag opening holder that is easy and convenient to use and to open and keep open the bag.

Even still another object of the present invention is to provide a new bag opening holder that saves the user substantial time in filling bags with objects such as leaves.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
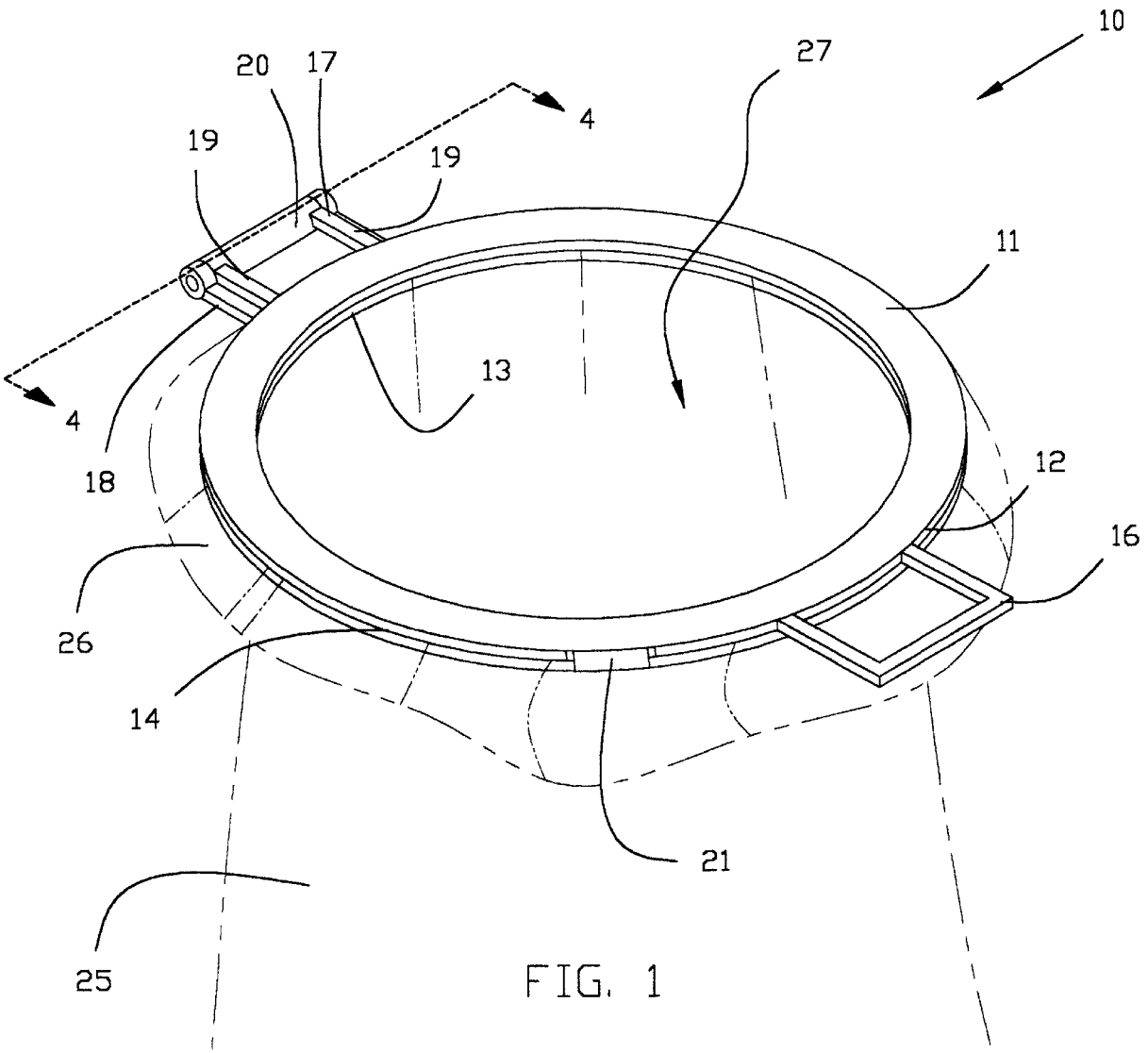
FIG. 1 is a perspective view of a new bag opening holder according to the present invention and being shown in use.
Figure 2:
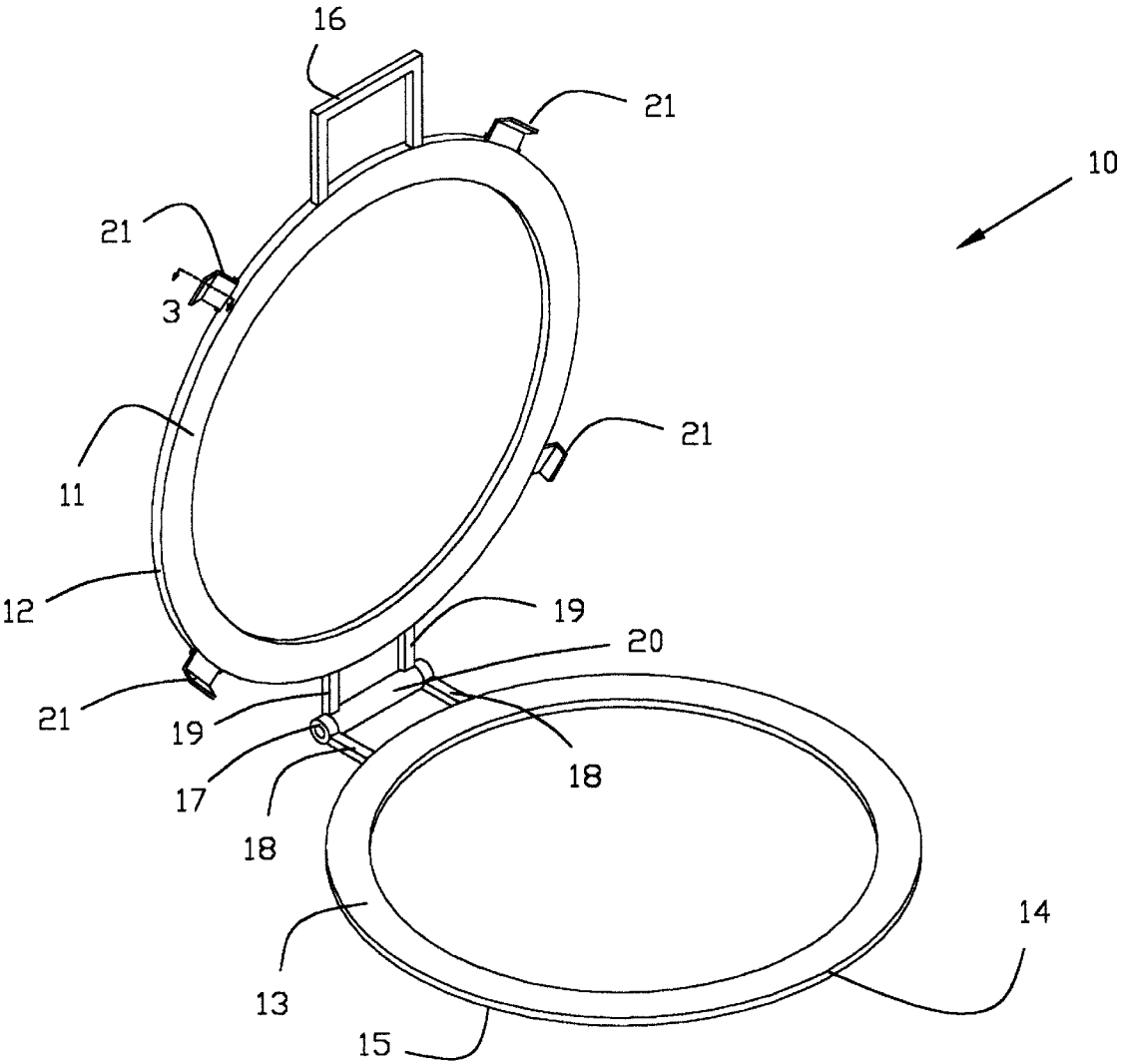
FIG. 2 is a perspective view of the present invention.
Figure 3:
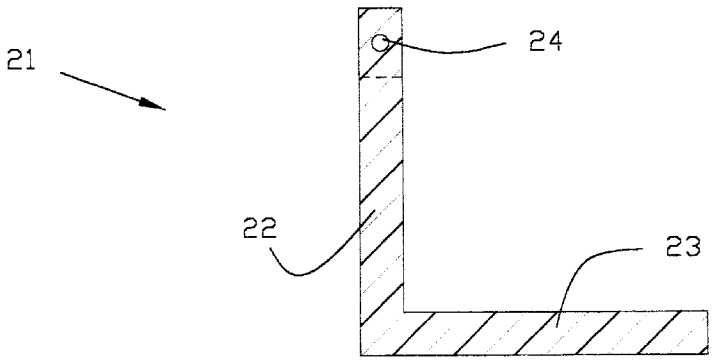
FIG. 3 is a cross-sectional view of one of the fastening members of the present invention.
Figure 4:
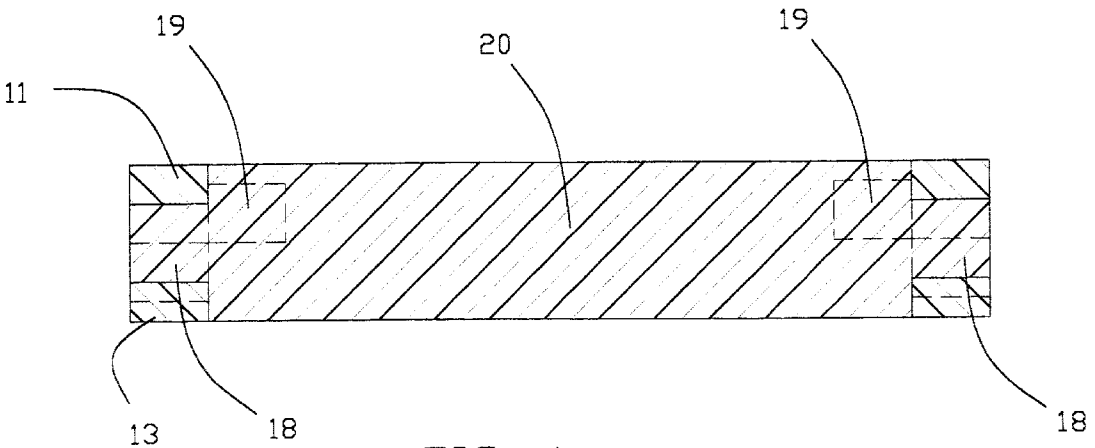
FIG. 4 is a cross-sectional view of the second handle member of the present invention.

With reference now to the drawings, and in particular to FIGS. 1 through 4 thereof, a new bag opening holder embodying the principles and concepts of the present invention and generally designated by the reference numeral 10 will be described.

As best illustrated in FIGS. 1 through 4, the bag opening holder 10 generally comprises a first ring member 11 having an opening therethrough, and also comprises a second ring member 13 having an opening therethrough and being hingedly attached to the first ring member 11 with the first and second ring members 11,13 each having a diameter of approximately 22 inches.

The bag holding member 10 also includes handle members 16,17 having a first handle member 16 being securely and conventionally attached to the first ring member 11 and also having a second handle member 17 being securely and conventionally attached to the first and second ring members 11,13. The first handle member 16 is securely and conventionally attached to a circumferential edge 12 of the first ring member 11 and extends outwardly therefrom. The second handle member 17 includes first extended members 18 being spaced apart and extending outwardly from a circumferential edge 14 of the second ring member 13, and also include second extended members 19 being spaced apart and extending outwardly from the circumferential edge 12 of the first ring member 11, and further includes a hinge member 20 being securely and conventionally attached at ends of the first and second extended members 18,19 with the second handle member 17 being diametrically opposed to the first handle member 16. The first and second extended members 18,19 has a length of approximately 5½ inches. The first extended members 18 as well as the second extended members 19 are spaced approximately 3 inches apart.

Fastening members 21 are spaced apart and are securely and conventionally attached to the first ring member 11 for securely fastening the first ring member 11 to the second ring member 13 about an upper portion 26 a bag 25. Each of the fastening members 21 is essentially a clip 21 having a first portion 22 having an end hingedly attached with a pin 24 to the circumferential edge 12 of the first ring member 11 and also having a second portion 23 being integrally attached to and angled relative to the first portion 22. Each second portion 23 is angled approximately 90 degrees to a respective first portion 22, and is engageable to a bottom side 15 of the second ring member 13 to essentially clamp the first and second ring members 11,13 together with the upper portion 26 of the bag 25 near an opening 27 thereof being engaged between the first and second ring members 11,13.

In use, the user holds the opening 27 in a bag 25 open by extending an upper portion 26 of the bag 25 up through the opening in the second ring member 13 from the bottom of the second ring member 13 and by extending the upper portion 26 of the bag 25 about the second ring member 13, and then closes the first ring member 11 upon the second ring member 13 with the upper portion 26 of the bag 25 being securely engaged between the first and second ring members 11,13, and then fastens the first ring member 11 to the second ring member 13 by using the fastening members 21 as shown in FIG. 1.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bag opening holder comprising:

a first ring member having an opening therethrough;

a second ring member having an opening therethrough and being hingedly attached to said first ring member;

handle members including a first handle member being attached to said first ring member and also including a second handle member being attached to said first and second ring members, said second handle member pivotally connecting said first and second ring members together, said first and second handle members being located at substantially opposite locations on said first ring member for holding by a hand of a user; and fastening members being spaced apart and being securely attached to said first ring member for fastening said first ring member to said second ring member and about an upper portion of a bag;

wherein said second handle member includes first extended members being spaced apart and extending outwardly from a circumferential edge of said second ring member, and also includes second extended members being spaced apart and extending outwardly from said circumferential edge of said first ring member, and further includes a hinge member being attached at ends of said first and second extended members and being spaced from said ring members to define an opening therebetween for permitting gripping of said hinge member by the hand of the user.

2. A bag opening holder as described in claim 1, wherein said first handle member is attached to a circumferential edge of said first ring member and extends outwardly therefrom.

3. A bag opening holder as described in claim 1, wherein each of said fastening members comprises a clip having a first portion having an end hingedly attached with a pin to said circumferential edge of said first ring member and also having a second portion being integrally attached to and angled relative to said first portion.

4. A bag opening holder as described in claim 3, wherein each said second portion is angled approximately 90 degrees to a respective said first portion, and is engageable to a bottom side of said second ring member for clamping said first and second ring members together with the upper portion of the bag near an opening thereof being engaged between said first and second ring members.

5. A bag opening holder as described in claim 1, wherein said hinge member is substantially cylindrical.

6. A bag opening holder comprising:

a first ring member having an opening therethrough;

a second ring member having an opening therethrough and being hingedly attached to said first ring member;

handle members including a first handle member being attached to said first ring member and also including a second handle member being attached to said first and second ring members, said second handle member pivotally connecting said first and second ring members together, said first and second handle members being located at substantially opposite locations on said first ring member for holding by a hand of a user; and fastening members being spaced apart and being securely attached to said first ring member for fastening said first ring member to said second ring member and about an upper portion of a bag;

wherein said first handle member is attached to a circumferential edge of said first ring member and extends outwardly therefrom;

wherein said second handle member includes first extended members being spaced apart and extending outwardly from a circumferential edge of said second ring member, and also includes second extended members being spaced apart and extending outwardly from said circumferential edge of said first ring member, and further includes a hinge member being attached at ends of said first and second extended members and being spaced from said ring members to define an opening therebetween for permitting gripping of said hinge member by the hand of the user;

wherein each of said fastening members comprises a clip having a first portion having an end hingedly attached with a pin to said circumferential edge of said first ring member and also having a second portion being integrally attached to and angled relative to said first portion;

wherein each said second portion is angled approximately 90 degrees to a respective said first portion, and is engageable to a bottom side of said second ring member for clamping said first and second ring members together with the upper portion of the bag near an opening thereof being engaged between said first and second ring members; and wherein said hinge member is substantially cylindrical.

* * * * *